United States Patent [19]

Marrs

[11] 4,174,839

[45] Nov. 20, 1979

[54] GOLF CLUB INCLUDING PUTTING GREEN SLOPE CORRECTION AIMING LINES

[76] Inventor: Duane K. Marrs, 806 2nd Ave., Monett, Mo. 65708

[21] Appl. No.: 888,766

[22] Filed: Mar. 21, 1978

[51] Int. Cl.[2] ..... A63B 69/36

[52] U.S. Cl. ..... 273/183 D; 273/164

[58] Field of Search ..... 273/63 R, 63 A, 63 B, 273/183 D, 32 R, 32 H, 163 R, 163 A, 164, 186 A, 162 R, 162 B, 167 D, 183 E

[56] References Cited

U.S. PATENT DOCUMENTS

| | | | |
|---|---|---|---|
| D. 205,041 | 6/1966 | Capps | 273/164 X |
| 1,485,272 | 2/1924 | Kinsman | 273/164 |
| 2,188,868 | 1/1940 | Shepard | 273/63 B X |
| 2,820,638 | 1/1958 | Morrison | 273/164 |
| 2,859,972 | 11/1958 | Reach | 273/164 |
| 3,118,678 | 1/1964 | Rohr | 273/163 A |
| 3,199,873 | 8/1965 | Surratt | 273/163 R |
| 3,680,860 | 8/1972 | Elkins | 273/183 D X |
| 3,751,819 | 8/1973 | Dixon | 273/32 H |
| 3,954,265 | 5/1976 | Taylor | 273/164 |
| 3,979,125 | 9/1976 | Lancellotti | 273/186 A |
| 4,005,870 | 2/1977 | Grace et al. | 273/32 H |

*Primary Examiner*—George J. Marlo

*Attorney, Agent, or Firm*—Fishburn, Gold & Litman

[57] ABSTRACT

A golf club, having a club head with an array of predetermined, easily visible, paired angled lines symmetrical about a visible center line on the club head top surface enables a golfer to establish a proper initial path for the golf ball so as to increase the putting effectiveness in the execution of putts on sloping greens.

5 Claims, 6 Drawing Figures

GOLF CLUB INCLUDING PUTTING GREEN SLOPE CORRECTION AIMING LINES

BACKGROUND OF THE INVENTION

This invention relates to golf clubs and more particularly to a putter used in the execution of putts over sloping greens.

Previously, alignment lines found on the top surface of club heads have generally converged to a point on the striking surface and only gave the golfer an image of where to strike the ball on the club head. Such lines suggested to the golfer a point on the club head striking surface further from or nearer to the shaft so as to increase or decrease the flight of the ball. Prior lines have further directed the golfer in which direction to make the initial portion of the swing away from the ball so as to slice or hook a ball upon impact in the concluding portions of the swing. Such prior lines were found on clubs not used in the putting situation and no prior clubs are known which use a predetermined array of paired angled lines for the proper execution of putts; especially breaking putts over sloping greens. Prior lines on putters attempted to establish a proper visual image so as to putt a ball along a straight line path between the ball and the hole. Such prior lines failed to aid the golfer in taking into account that when putting on sloping greens, the proper path for the ball is not a straight line path between the ball and the hole but a path between the ball and hole not collinear with this straight line path.

Previously lacking were visible indications on the top surface of the club head to enable a golfer to properly establish a path non-collinear with the straight line path between the ball and the hole and to properly position the angularity of the club head striking surface so that the ball, upon striking, will follow the non-collinear path. Also absent was a proper arrangement of indications on the club head to assure the golfer that once the proper club head angularity is established, it is maintained throughout the putting process.

Also, prior lines have failed to give to the golfer continuous visual feedback of the entire putting situation, that is; the straight line path between the ball and the hole, the initial path that the ball must follow non-collinear with the straight line path, and the angle formed by the intersection of these two paths at the club head which angle will dictate the proper positioning of the club head striking surface.

Also, previously known were devices addressing the putting situation such as "viewer" devices external to the club head itself. Such devices did not give continuous and correct feedback to the golfer of the entire putting situation. Concentration was required on external aiming indicia which diverted the golfer's attention from the club head and the ball itself which violated a basic golf tenet of keeping one's eye on the ball. Also, such devices were susceptible to unfavorable weather conditions, difficulty of adjustment of the device itself, and the accentuation of the personalized sight difficulties of the golfer.

SUMMARY OF THE INVENTION

The present invention refers to a golf club equipped with a club head referred to as "mallet-shaped" that has been provided with a novel arrangement of easily visible lines on the club head top surface so as to aid the golfer in the execution of putts, and especially breaking putts, over sloping surfaces or greens.

A visible center line on the top surface of the club head also lies in a plane which is normal to the plane of the striking surface at the center of the striking surface. Such a center line is also preferably substantially perpendicular to the line formed by the intersection of the club head's top surface and striking surface. Paired lines also visible on the top surface of the club head, in this example, emanate from a point on the center line known as the focal point which is located toward the rear portion of the club head. These paired lines emanate from the direction of the focal point preferably to the edge formed by the intersection of the top surface and striking surface at equal angles relative to the center line, right and left of the center line, and therefore, will form a symmetrical array about the center line. More than one set of these paired angled lines are used as they represent initial multiple paths that the ball is to follow when the desired path is variously non-collinear with the straight line path between the ball and the hole.

Such paired angled lines and/or the ensuing spaces between adjacent angled lines may be so indexed or coded on the top surface so as to make each set of the multiple sets of paired angled lines and/or ensuing spaces more easily identifiable. The lines and coding may be affixed to the club head itself during the manufacturing process or may be affixed separately to the club head in any suitable manner so as to make the whole or part of the arrangement of lines removable and interchangeable.

One object of the invention is to provide the golfer with assistance for increasing the reliability of putting over sloping greens.

Another object is to give continuous visual feedback to the golfer of the proper maintenance of the club striking surface angularity during the putting process.

A further object is to provide the golfer with visual feedback throughout the putting process of the relationship established by the straight line path between the ball and the hole, the initial path non-collinear with this straight line path that the ball must take on sloping greens to insure putting accuracy and the proper angularity of the club striking surface so as to better assure that, upon striking, the ball will travel along this initial non-collinear path.

A still further object is to give the golfer visual means on the club head itself by which the golfer can determine the initial path that the ball must follow when such path is, because of sloping greens, not a straight line path between the ball and the hole.

Other objects and advantages of this invention will become apparent from the following description taken in connection with the accompanying drawings wherein are set forth, by way of illustration and example, certain embodiments of this invention.

DESCRIPTION OF THE PREFERRED EMBODIMENTS

Figure 1:
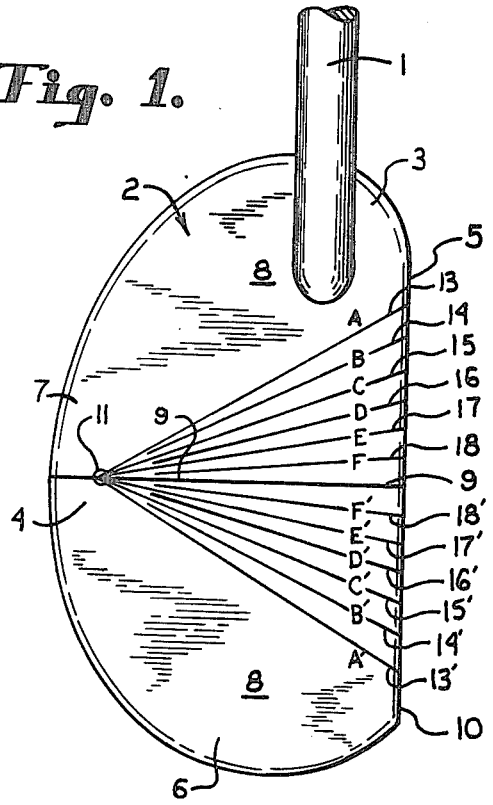
FIG. 1 is a fragmentary top plan view showing the top surface of the club head, the arrangement of lines on the top surface and a portion of the shaft affixed to the club head.
Figure 6:
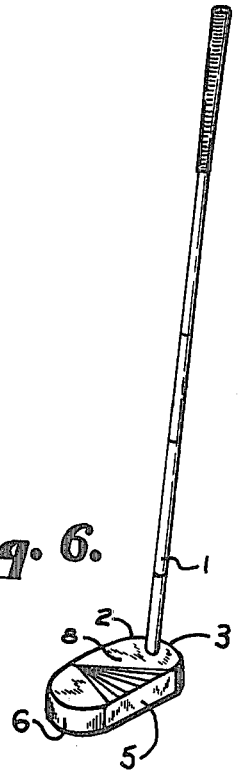
FIG. 6 is a perspective view of the entire golf club.
Figure 2:
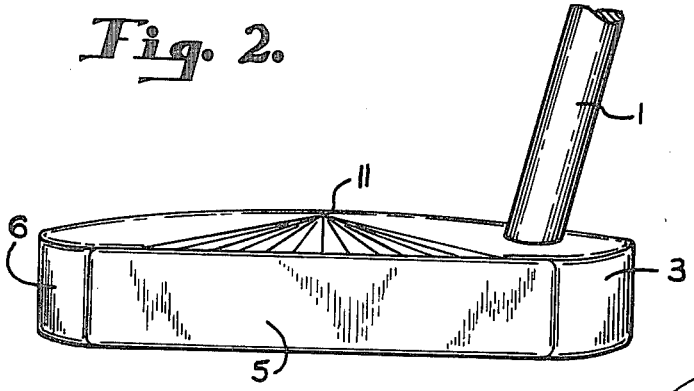
FIG. 2 is a front perspective view of the club head showing the ball striking surface and the top surface with the lines thereon.

In particular reference to the drawings of the invention, FIG. 1 shows a shaft 1 attached to the club head 2 toward the heel portion 3 thereof. The axis of the shaft 1 may lie in a plane parallel to the plane of the striking surface 5 of the club head 2. The club head 2, as shown, is typically referred to as a "mallet" type head which, in this example, is made up of a vertical planar surface 5, best shown in FIG. 2 and referred to as the "striking surface". The club head also has a heel portion 3, toe portion 6, rear portion 7 and a top surface 8. A conventional bottom surface is not shown. As stated, the foregoing parts are so arranged as to form a "mallet" type club head as shown in FIGS. 1 and 2. The top surface 8 is preferably planar and normal or at slight variations from normality to the striking surface 5.

A center line 9 visible on the top surface 8 is perpendicular to the edge 10 of the club head 2 formed by the intersection of the top surface 8 and the striking surface 10. Preferably this center line 9 lies in a plane which is normal to the striking surface and intersects the striking surface at a point where the ball is most consistently struck or preferred to be struck.

A focal point 11 lies on the center line 9 toward the rear portion 7 of the club head 2. Visible paired lines 13—', 14–14', 15–15', 16–16', 17–17', 18–18', emanate from, or in the direction of, the focal point 11 to the line or edge 10 formed by the intersection of the top surface 8 and the striking surface 5. As shown in FIG. 1, these paired angled lines 13–13' to 18–18' form right and left angles relative to the center line 9.

The arrangement or array of right and left angled lines may vary in the angularity of the paired lines and in the number of sets of such paired lines. This particular arrangement of paired angled lines 13–13' to 18–18' as to angularity and number, that is, about five degrees between adjacent lines, have been found by the applicant to be an advantageous arrangement of angled lines and ensuing spaces therebetween.

The arrangement of these angled lines 13–13' to 18–18' are paired congruent right and left angled lines emanating from the focal point 11 on the center line 9 to the top surface edge 10 and because of angle congruency, are symmetrical about the center line 9. The angle of emanation of these paired right and left angled lines will differ among the diverse pairs, but right and left angled lines within each specific pair exemplarily emanate at equal angles. Thus the whole arrangement or array of the right and left angled lines will be symmetrical about the center line 9.

The arrangement of these visible lines may be put on the club head 2 during the manufacturing process, or if the golfer desires interchangeability of these lines, whether as to number, angularity or placement, the desired arrangement of paired right and left angled lines symmetrical about a center line may be put on a separate surface (not shown) which may then be put on the club head top surface 8 so as to give the individual easily identifiable visual indications, similar to the effect given by the placement of such lines during the manufacturing process.

Coding of these angled lines and/or ensuing spaces therebetween may also appear on the top surface 8 of the club head 2 so as to assist the golfer in the easy identification of specific sets of paired right and left angled lines and/or spaces.

Once the novel arrangement of these lines has been properly established and affixed on the top surface 8, the golfer, when properly using the club, will be given visual feedback so as to enable the establishment of an initial path for the ball, the angularity of the striking surface 5 needed to strike the ball along the initial path and assurances that the angularity of the head has been properly established and maintained during the putting process.

Operation

When faced with a putt on a sloping green, the golfer realizes that the path that the ball will take cannot be a straight line path between the ball and the hole, but must be a non-collinear path on the uphill side of the straight line path so as to allow for the "break" of the ball caused by the slope of the green. Thus the golfer must initially strike the ball toward an imaginary target at an angle right or left from the straight line path between the ball and hole. With the proper operation of the golf club equipped with the previously described club head, with its novel arrangement of lines and ensuing spaces inbetween visible on its top surface, the striking surface 5, and thus the club head 2 itself relative to the straight line path, can be properly positioned. Also with the checks made possible by the arrangement of these visible right and left angled lines, the golfer can assure himself that the angularity of the club head is properly maintained during the putting process. With experience and use of the club, the golfer will also be able to establish the proper initial (target) path that the ball must take to insure high putting accuracy.

Figure 5:
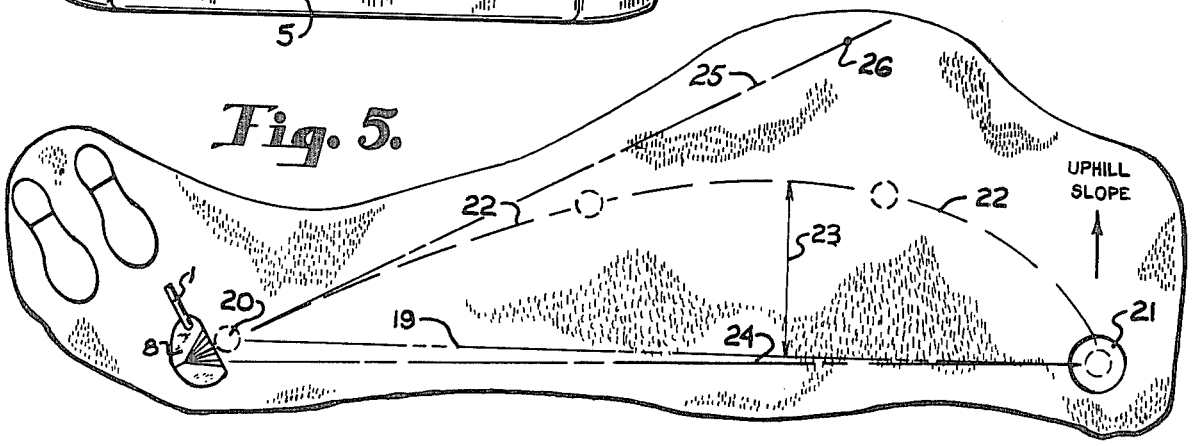
FIG. 5 is a diagrammatic view similar to FIG. 4 but on a smaller scale and showing a portion of the putting green and the golfer's feet in a square stance position.
Figure 3:
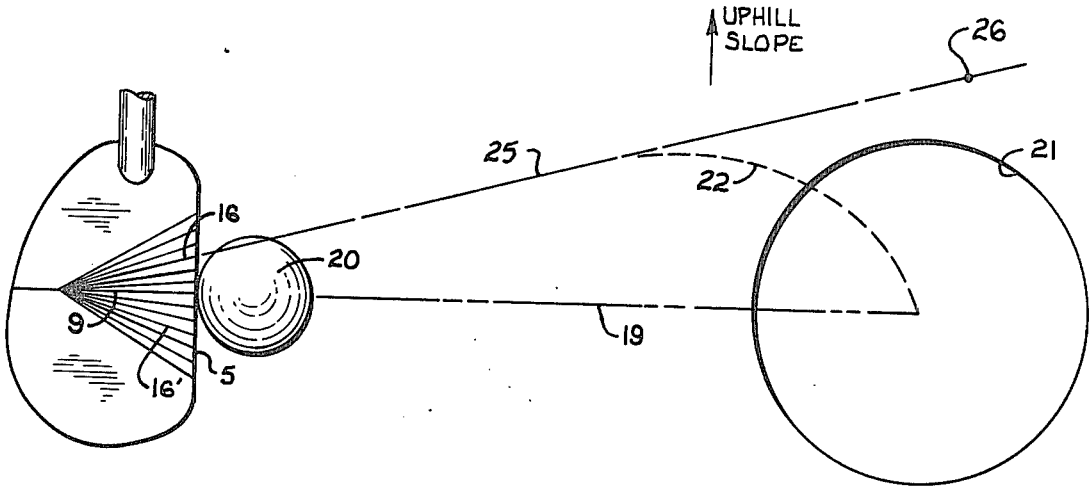
FIG. 3 is a diagrammatic view showing a putting situation and an initial placement of the club head.

Assume the golfer is faced with a putting situation as shown in FIG. 5. The distance between the ball 20 and the hole 21 is of such a distance that the slope of the green will have an effect on the path of a golf ball rolling across the green. Shown in FIG. 5 is a straight line path 19 between the ball and the hole. Break 23 as shown in FIG. 5 is defined as the greatest distance the ball 20 will displace from a straight line path when travelling on a non-collinear path 22 from the ball 20 to the hole 21 as measured from the straight line path 19 between the ball and the hole 21. The uphill portion of the sloping green is assumed to be to the golfer's left of the straight line path 19. The club equipped as previously described and with a head is shown in FIG. 1 by one procedure may now be used as follows:

STEP 1. As shown in FIG. 3 the golfer first positions the club head 2 so that the center line 9 is aligned and collinear with the straight line path 19.

STEP 2. The golfer then establishes a path that the ball must take so as to allow for the break of the ball because of the slope of the green. This is commonly known as "reading" the green. Assume that the path 22 as shown in FIG. 5 will be the path that the ball is to follow. Once the green is "read" the golfer establishes a reference aiming point or target point 26 towards which the ball is to be initially struck. The target point 26 is so chosen as to allow for the "break" of the putt on the sloping green. As shown, the golf ball must be struck at an angle to the left of the established path 19.

STEP 3. Having established the non-collinear path 22 the golfer then views the paired left and right angled lines 13–13' to 18–18' to determine which left angled line and extension thereof of each paired angle set will most nearly determine the initial path of the path 22 that the ball must follow upon being struck and includes the target point 26 toward which the ball is to be struck. If the desired path is not exactly represented by the available left angled lines, the golfer can, by mentally projecting similar angled lines in the ensuing spaces between the lines, establish a determinative path intersecting the desired target point 26. Assume left angled line 16 of the set 16–16' is that line which most nearly determines the initial portion of the established path 22 and intersects the target point 26. The extension of left angled line 16 defines a target line 25 intersecting the target 26, FIG. 3. The angular and spacial differences in the initial portion of the path 22 and the target line 25 are negligible, so that the initial portions of the respective paths 22 and 25 may be considered collinear (FIG. 4) with no evident effect on the use of the golf club as described. With experience, the golfer may now make a mental check as to whether the target line 25, directed by line 16, will give the golfer the desired path.

Figure 4:
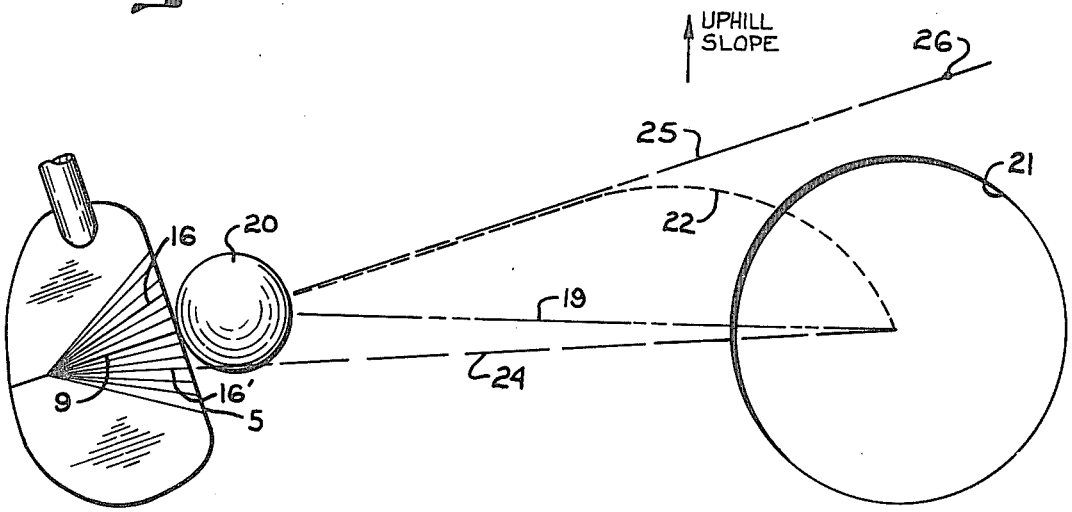
FIG. 4 is a diagrammatic view showing the same putting situation as in FIG. 3 with the club head angularity properly determined and the club head ready for striking.

STEP 4. The golfer now establishes the proper angularity of the striking surface 5 relative to the straight line path 19 by turning the club head 2 as shown in FIG. 4 so that the center line 9 which was collinear with the straight line path 19 will be pointing to the intended target point 26. The key check now available is that, if the club head is properly positioned, the extension of right angled line 16' as designated by line 24 will be pointing substantially to the center of the hole, as shown in FIG. 4. The proper club head angularity is now established as shown in FIG. 4 and the golfer should adjust his feet accordingly to assume his natural putting stance.

STEP 5. The golfer may now strike the ball by a swing along the center line 9 (FIG. 4) with more assurance that the ball will initially travel along the established path 22, and break into the hole 21.

It is to be understood that while certain forms of this invention have been described, it is not to be limited thereto, except insofar as such limitations are included in the following claims.

Having thus described the invention, what is claimed and desired to secure by Letters Patent is:

1. A golf club including a shaft, a mallet type club head affixed to said shaft and having a ball striking surface, said head including a top surface intersecting with said striking surface, and having a ball aiming arrangement comprising:

(a) a thin, elongate visible center line on said head top surface and extending substantially perpendicularly to the intersection of said top surface and said striking surface for establishing a ball striking path for squarely hitting the ball;

(b) a focal area on said head top surface, said focal area being aligned with said center line and spaced from said striking surface;

(c) a plurality of visible straight indicating lines on said top surface and emanating from the direction of said focal area, said indicating lines forming a congruent array of multiple pairs of indicating lines on said top surface and extending in opposed angular directions from said center line to said intersection for establishing a series of selective aiming paths directly from the club to a target angularly deviating from the ball striking path; and (d) coded indicia on said top surface identifying respective indicating lines.

2. The golf club as set forth in claim 1 wherein:

(a) said center line extends rearwardly of said striking surface past said focal area.

3. The golf club as set forth in claim 1 wherein:

(a) said center line forms the symmetrical center of said array.

4. The golf club as set forth in claim 1 wherein:

(a) adjacent indicating lines form an angle of about five degrees.

5. The golf club as set forth in claim 1 wherein:

(a) less than all of said indicating lines extend to said focal area.

* * * * *